United States Patent [19]

Paradis

[11] Patent Number: 4,553,683

[45] Date of Patent: Nov. 19, 1985

[54] TAMPER RESISTANT CLOSURES

[76] Inventor: Joseph R. Paradis, 60 Plymouth Rd., Holden, Mass. 01520

[21] Appl. No.: 635,409

[22] Filed: Jul. 30, 1984

Related U.S. Application Data

[63] Continuation-in-part of Ser. No. 441,557, Nov. 15, 1982, Pat. No. 4,462,505.

[51] Int. Cl.[4] ..... B65D 41/02; B65D 41/32

[52] U.S. Cl. ..... 220/266

[58] Field of Search ..... 220/266, 267; 215/203, 215/206, 250, 223

[56] References Cited

U.S. PATENT DOCUMENTS

| | | | |
|---|---|---|---|
| 3,608,771 | 9/1971 | Monroe | 220/266 |
| 4,231,486 | 11/1980 | Bock | 220/266 |
| 4,462,505 | 7/1984 | Paradis | 220/266 |

*Primary Examiner*—George T. Hall

[57] ABSTRACT

A tamper-proof resealable closure formed by a cap with an elongated neck that is integrally sealed to a housing. The neck includes a set of outer ribs which guide the cap into the housing when the tamper-proof seal is broken and the cap is depressed. The ribs are configured relative to the housing to further provide a relatively moisture-proof seal between the cap and the housing when the cap is rotated after having been depressed into the housing. The temporary moisture-proof seal is released by simple rotation of the cap to its original position of depression. The cap is removable and temporarily resealable as desired. The cap may be stabilized to prevent accidental rupture of the seal by the inclusion of one or more peripheral stabilizing panels which can be releasably joined to the housing by connectors which are severable upon slight rotation of the cap.

19 Claims, 19 Drawing Figures

TAMPER RESISTANT CLOSURES

This application is a continuation-in-part of Ser. No. 06/441,557, filed Nov. 15, 1982, now U.S. Pat. No. 4,462,505.

BACKGROUND OF THE INVENTION

This invention relates to tamper-proof closures, and, more particularly, to tamper-proof closures which are resealable.

A tamper-proof closure is one that provides a clear visual indication when it has been disturbed. Attempts have been made to provide a tamper-proof characteristic for closures to by using shrink fitting plastic sheeting. In order to open the closure it is necessary to remove the plastic sheeting which has been shrunk about the closure to act as a seal. Once the sheeting is destroyed the associated closure can be opened, but the protective material is no longer usable and must be discarded. In addition the use of shrinkable sheetings does not provide a clear visual indication of when the seal has been removed. Generally close scrutiny of the associated container is needed to verify that the seal has been broken.

In another attempt to provide a tamper resistant characteristic for closures, metallic caps have been provided with flanged skirts which are clamped to the lower lip of their associated containers. This kind of closure affords only a limited degree of protection against tampering since generally the skirted extension of the cap can be pried away from the associated lip, the cap opened, and then afterwards returned to its original position and the skirt repositioned against the lip of the container.

Another attempt to achieve a tamper-proof characteristic of closures has been attempted by using duplex plastic caps in which one part of the cap must be sheared away to obtain access to the contents of the container which makes use of the cap. Once the cap is sheared away the container requires a separate stopper for resealing, although the required shearing does achieve a degree of tamper resistance. There is, nevertheless, the objection that the duplex cap must be applied to its associated container and that the composite cap can often be removed so that the tamper-proof characteristic of the shearable upper portion can be frustrated by simply removing the entire cap.

Accordingly, it is object of the invention to facilitate the tamper-proof sealing of containers. A related object is to achieve tamper-proof sealing in which the tamper-proof portion of the closure cannot be either deliberately or accidentally removed from its associated container.

Another object of the invention is to achieve a tamper-proof seal in which there is a clear visual indication to the user of when the seal has been broken. A related object is to eliminate seals which provide tamper resistance but simultaneously fail to provide a clear indication of when the seal has been disturbed. Another related object is to eliminate the use of shrinkable sheet material in attempting to provide a tamper-proof characteristic for closures associated with containers.

Still another object of the invention is to provide a tamper-proof closure which can be resealed once the initial tamper-proof seal has been broken. A related object is to avoid the use of plastic seals, such as those associated with duplex closures, in which rupture of the initial seal prevents any reuse of the original closure and instead requires the procurement of an auxiliary closure once the initial seal has been disturbed. A related object is to eliminate the need for duplex closures which may be pried away or otherwise separated from their associated containers and thus defeat the desired tamper-proof characteristic that is being sought.

SUMMARY OF THE INVENTION

In accomplishing the foregoing and related objects, the invention provides a cap that is integrally sealed to a housing, with the cap having a body portion that extends above the level of the seal to provide a clear visual indication that the connection of the cap to the housing has not been disturbed. A flange is desirably provided on the cap to facilitate the rupture of the seal connecting the cap to the housing. In addition, the housing and the cap are provided with cooperating structures which permit the cap to be resealed on the housing once the initial integral and tamper-proof seal has been broken.

In accordance with one aspect of the invention, the resealing of the cap to the housing is accomplished by the inclusion of inclined ramps that extend along the outside surface of the neck of the cap above the seal to the housing. The latter in turn is provided with weakened regions which accommodate the inclined ramps once the seal between the cap and the housing has been broken and the cap has been depressed into the housing.

In accordance with another aspect of the invention, the housing is provided with stop members which permit the required orientation of the cap relative to the housing after the container has been resealed and the cap is to be subsequently removed from the housing.

In accordance with a still further aspect of the invention, the housing is provided with circumferential inclined ramps which engage structural portions of the axial ramps on the cap in order to permit the achievement of comparatively moisture resistant closure of the cap and the housing once the integral tamper-proof seal has been broken.

In accordance with yet another aspect of the invention, the seal which integrally joins the cap with the housing has a tapered increasing thickness from the housing to the cap. The maximum thickness of the integral seal at its position of connection to the cap is about 0.005 inches.

In accordance with still another aspect of the invention, the flange on the cap which permits the tamper-proof seal to be broken is advantageously in the form of an eccentric member with respect to the central axis of the cap, with a lip that extends beyond the peripheral outer limits of the cap so that the application of thumb pressure to the lip provides a lever effect and facilitates the desired rupture of the tamper-proof seal when access to the contents of the associated container is desired. The inclined vertical ramps on the caps that permit the resealing of the cap relative to the housing desirably straddle the lip so as to provide neglible interference with the rupture force applied at the lip.

In accordance with a further aspect of the invention, the flange on the cap is provided with side panels which depend downwardly from the edges of the flange into contact with upwardly extending members from the housing. One purpose of the side panels is to stabilize the flange in relation to the housing to prevent premature rupture of the integral seal that connects the cap to the housing. At least one such stabilizing side panel is included, together with an upstanding support from the housing. The side panel and the support are advantageously joined by an easily ruptureable connector. It is desirable for the cap to include at least two such stabilizing side panels and corresponding supports, but a larger number may be employed as well.

DESCRIPTION OF THE DRAWINGS

Other aspects of the invention will become apparent after considering several illustrative embodiments, taken in conjunction with the drawings in which.

DETAILED DESCRIPTION

Figure 1A:
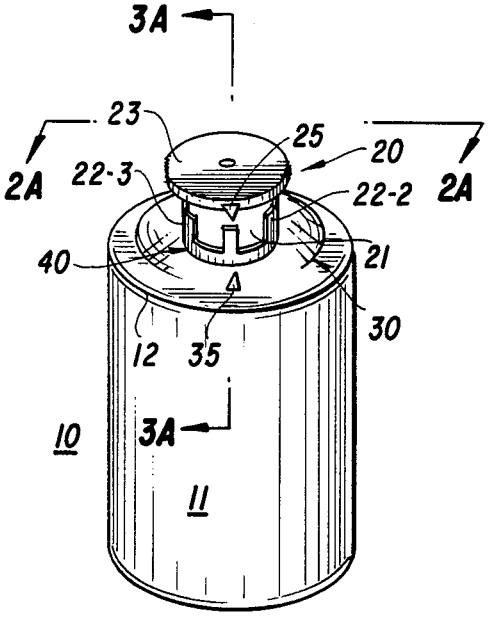
FIG. 1A is a perspective view of a container provided with a tamper-proof closure in accordance with the invention, featuring a cap with an elongated neck that gives a clear visual indication that the tamper-proof seal between the cap and the associated housing has not been disturbed.

With reference to the drawings, a container 10 is shown in FIG. 1A provided with a cap 20 that is connected to a housing 30 by a tamper-proof seal 40.

The housing 30 is permanently sealed to the cup portion 11 of the container 10 in any convenient way. An illustrative connection of the housing 30 to the cup portion 11 can be made along the line of separation 12 between the two by heat sealing, mechanical fastening or any other convenient way. In order to prevent interference with the tamper-proof characteristic for the container 10 afforded by the invention, the junction between the housing 30 and the cup 11 is made permenant, so that separation of the housing from the cup would require destruction of the container.

The cap 20 is provided with an elongated neck 21 that includes a set of inclined ramps, of which the ramps 22-2 and 22-3 are partly visible in FIG. 1A. A third ramp 22-3 is positioned on the neck 21 opposite and symmetrically disposed with respect to the second ramp 22-2. The ramps 22-1 through 22-3 are all in the form of inclined planes on the outer surface of the neck 21. Their function in relation to the housing 30 will become apparent from the discussion below. The cap 20 also includes an upper flange 23 with a lip 24 that extends outwardly beyond the neck 21 in order to facilitate the rupture of the seal 40 when access is desired to the interior contents of the container 10.

When pressure is applied downwardly upon the cap 20, desirably by the thumb at the lip 24, the cap 20 is depressed into the housing 30, guided by the ribs 22-1 through 22-3. The result is that the cap 20' occupies the position relative to the housing 30 shown in FIG. 1B. In addition, the cap 20' in FIG. 1B has been rotated relative to the housing 30 to provide a comparatively moisture resistant seal. To undo the temporary seal effected in the position shown in FIG. 1B the cap 20' is simply rotated in the clockwise direction indicated by the arrow C until the cap 20' has the same relative orientation to the housing 30 as in FIG. 1A. The cap 20' can then be removed by being lifted upwardly with the repositioned ribs 22-1 through 22-3 again providing the desired separational guidance.

Figure 1B:
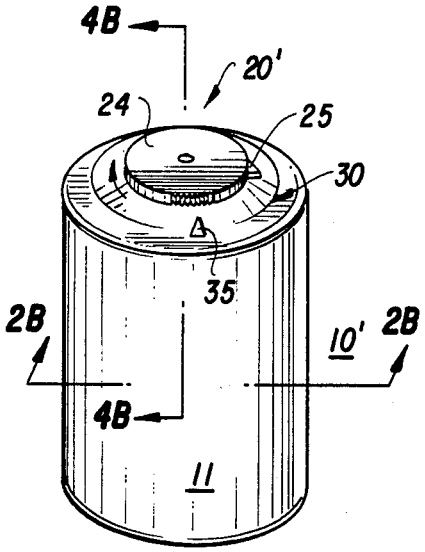
FIG. 1B is a perspective view of the container of FIG. 1A in which the tamper-proof seal has been broken, as visually indicated by the depressed position of the cap relative to the associated container.
Figure 2A:
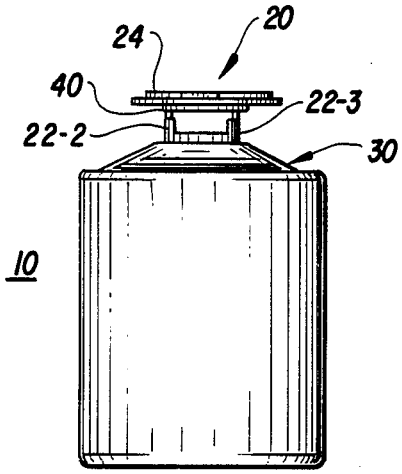
FIG. 2A is a side view of the container of FIG. 1A, which, like FIG. 1A, demonstrates the orientation of the cap relative to the container before the tamper-proof seal between the cap and container has been broken.
Figure 2B:
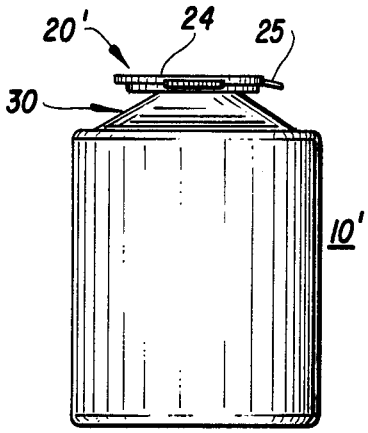
FIG. 2B is a side view of the container of FIG. 1B, illustrating further the position of the cap relative to the associated container once the tamper-proof seal has been broken.

Side views of the containers 10 and 10' of FIGS. 1A and 1B are shown in FIGS. 2A and 2B to emphasize the significant visual difference afforded by the invention before and after rupture of the seal 40. Once the seal 40 has been ruptured, the cap 20 must be either removed or depressed into the housing 30 as shown in FIG. 2B, thus providing a clear visual indication of when the seal 40 has been disturbed. In addition, since the cap can be depressed into the container it is not necessary to provide an auxiliary closure. Instead, the same cap 20 that is used in tamper-proof engagement with the housing 30 is also usable to close the container 10 as desired. In addition, by rotating the cap 20', in its depressed position, the invention provides a relatively moisture resistant resealing of the container 10 as shown for the container 10' of FIG. 2B.

Figure 3A:
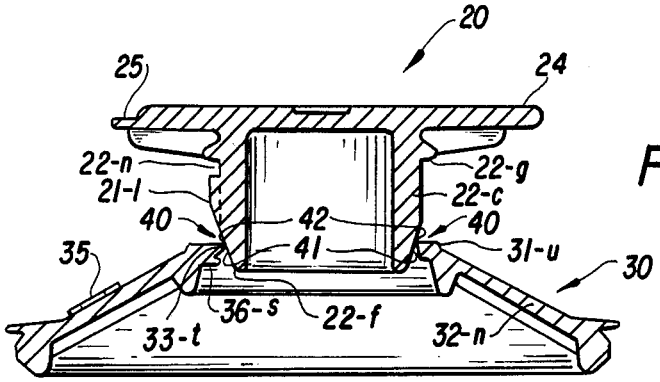
FIG. 3A is a sectional view of the cap and associated housing of FIGS. 1A and 2A.
Figure 3B:
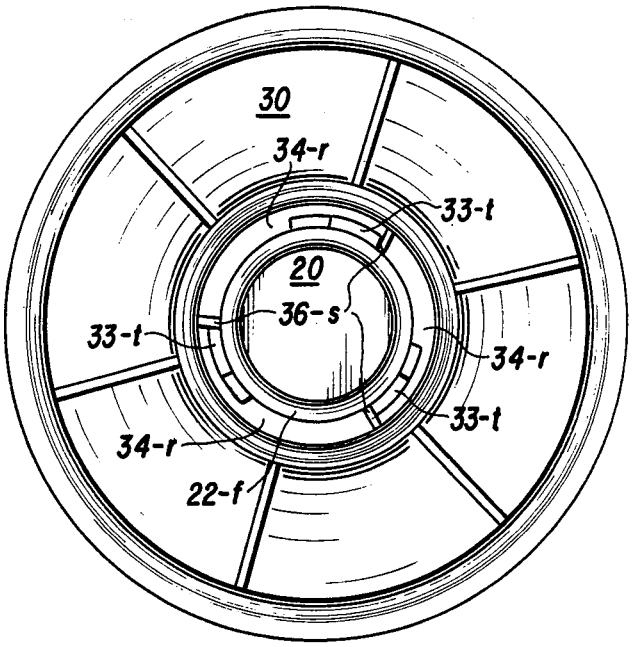
FIG. 3B is a sectional view of the containers in FIGS. 1A and 2A showing constructional details of the underside of the housing in FIG. 3A.

Structural details for the relationship between the cap 20 and the housing 30 are set forth in FIG. 3A. The cap 20 is shown with one of the ribs 22-1 in the form of a inclined ramp extending upwardly to a notch **22-*n*. It will be appreciated that the same structure is employed with the other ribs 22-2 and 22-3 which are not visible in FIG. 3A. The remainder of the cap 20 includes a circumferential ledge 22-*g* which is positioned above the notch 22-*n* and circumferentially surrounds the cylindrical side wall 22-*c* of the cap. When the cap 20 is depressed into the housing 30, the ledge 22-*g* is seated on the upper housing surface 31-*u* of FIG. 3A. The cylindrical shell 22-*c* of the cap 20 extends to a frustoconical lower portion which is integrally attached at approximately its midposition to the sealing membrane 40. The latter is a frustoconical extension from the neck 32-*n* of the housing 30. The sealing membrane 40 has a lower surface 41 which is substantially perpendicular to the frustoconical extension 22-*f* of the cap 20. The upper portion 42 of the sealing web 40 is an extension of the upper surface 31-*u* of the housing. The surfaces 41 and 42 of the seal 40 converge towards one another at the surface of the cap 22-*f* and have a thickness about 0.005 inch which has been found to be particularly suitable in the case of molded plastic materials. Those regions of the housing 30 below the ribs 22-1 through 22-3 are specially molded to receive the downward thrust of the cap 20 when the seal 40 is broken. For that purpose the housing 30 includes a tapered undercut 33-*t* which yields upon depression of the cap and returns to its equilibrium position shown in FIG. 3A once the cap is depressed. This action is sufficient in the general case to provide a relatively tight seal between the depressed cap 20 and the housing 30**.

In addition, the invention provides for achieving of a relatively moisture proof seal by the inclusion of tapered circumferential ramps **34-*r* extending from the notch positions 33-*t* associated with the ribs 22-1 through 22-3. Consequently when the cap 20, after being depressed into the housing 30 is rotated in a counterclockwise direction the lower lip of each notch 22-*n* bears against the ramp and draws the guide 22-*g* tightly against the upper surface 31-*u***.

Figure 4D:
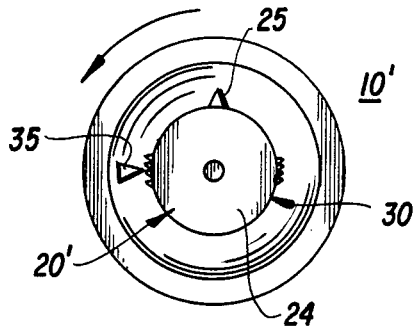
FIG. 4D is a top view of the container of FIG. 2B showing a cap resealed to a housing in accordance with the invention.
Figure 4A:
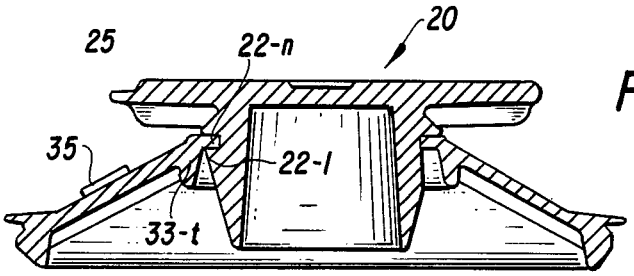
FIG. 4A is a cross-sectional view of a cap and a housing in accordance with the invention after the seal between the cap and the housing has been ruptured and the cap has been depressed into the housing.
Figure 4B:
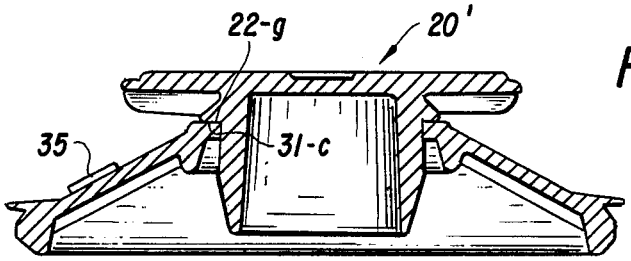
FIG. 4B is a cross-sectional view showing the housing and cap of FIG. 4A after the cap has been rotated to reseal the closure as shown in FIG. 2B.

Separation of the cap 20 from its resealed position shown in FIGS. 1B, 2B and 4B is readily achieved by rotating the resealed cap to its initial position which is indicated by the alignment of a cap arrow 25 with a housing arrow 35. In addition, the precise positioning of the cap 20 for removal from the housing 30 is assured by the inclusion of a stop **36-*s* at each notch position. Because of the precision alignment assured by the presence of the stops 36-*s* the alignment arrows 25 and 35** may be eliminated if desired.

Figure 3C:
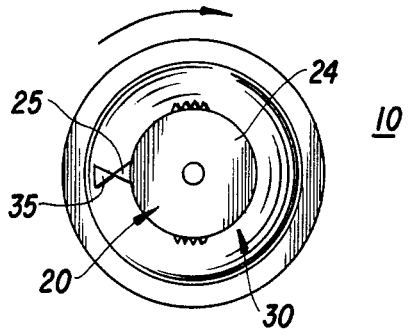
FIG. 3C is a top view of the container of FIG. 2A showing the position of the cap relative to an associated housing for rupturing the tamper-proof seal between the cap and the housing.

Once the cap arrow 25 is aligned with the housing arrow 35, for example, after the cap has been rotated from the position shown in FIG. 4D to the position shown in FIG. 3C, the cap is readily separated from the housing by applying thumb pressure at the lip 24 which causes the cap to be flipped from the housing. It is to be noted that when initial thumb pressure is applied to break the seal 40, once the seal is broken the cap will tumble from the housing unless it is depressed into the housing as shown in FIG. 4A. The tumbling action results from the effect of the ramp portions of the ribs 22-1 through 22-3 against their respective tapered undercuts **33-*t***.

Figure 4C:
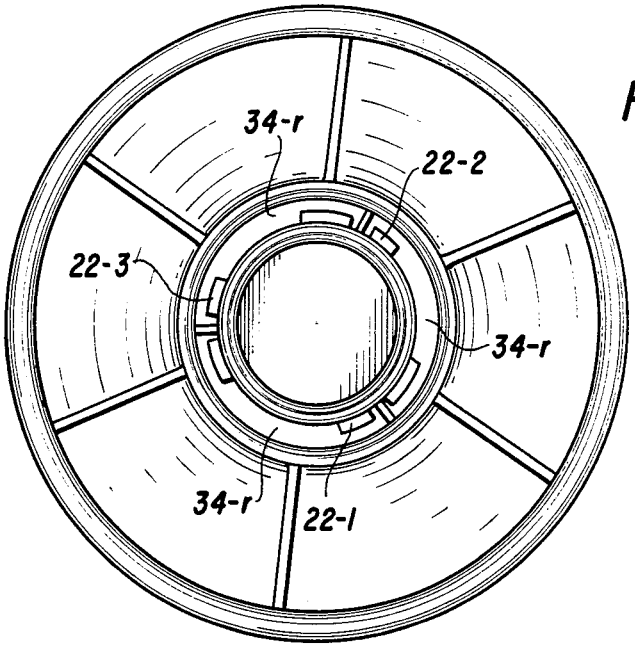
FIG. 4C is a cross-sectional of the containers in FIGS. 1B and 2B showing the reseal engagement of the cap with the housing as viewed on the underside of the housing.

When the cap 20 of FIG. 3A is initially depressed it occupies the position 20″ shown in FIG. 4A. In this position the ribs 22-1 through 22-3 are at the notches **33-*t*. To provide a releasable seal of the cap 20″ relative to the housing 30, the cap is rotated so that it occupies the position shown in FIG. 4D with the cap arrow 25 moved in a clockwise direction by substantially 90 degrees relative to the housing arrow 35. The result is as indicated in FIG. 4B with the ribs rotated away from the notch position and into a relatively tight seal of the ring 22-*g* against the upper surface 31-*u* of the housing because of the movement of the ribs at their notches 22-*n* against the circular inclined ramps on the underside of the housing. The result is as indicated in FIG. 4C**.

In an illustrative embodiment of the invention the cap and housing were produced by injection molding of a polyethylene-polypropylene copolymer, such as copolymer No. 7523 of the Hercules Chemical Company. This molding resulted in a seal between the cap and the housing having a minimum thickness about 0.005 inches. The housing was then snapped into a cylindrical cup in order to form a container, with the housing and cap being hermetically sealed to the cup. In testing it was found that the cap could be pushed into the housing, breaking the tamper-proof seal, by applying a downward force between 12 and 14 pounds. The cup had a diameter of about 2 inches and a height of about 3 inches, providing a volume on the order to 60 cubic centimeters. It will be appreciated that the cup portion can take any of a variety of configurations, being rectangular in cross-section, instead of circular and that any convenient method of bonding the housing to the cup may be employed.

While a seal thickness of about 0.005 inches has been found to be particular suitable, it will be appreciated that other seal thickness may be employed as well. Any particular seal thickness below about 0.008 inches have been useful, depending upon the force desired for rupture when the tamper-proof seal is to be deliberately broken. In general the minimum seal thickness is in the range from about 0.001 to about 0.006 inches.

In addition, the sealing ramps that are circumferentially positioned on the underside of the housing below the seal can also include notches to promote the integrity of the temporary moisture-proof seal of the cap to the housing after the tamper-proof seal has been broken and the cap depressed into the housing extended circumferentially beyond the widths of the ribs on the neck of the cap in order to accommodate the twisting action that is used for the embodiment of FIGS. 5A through 6C.

Figure 5A:
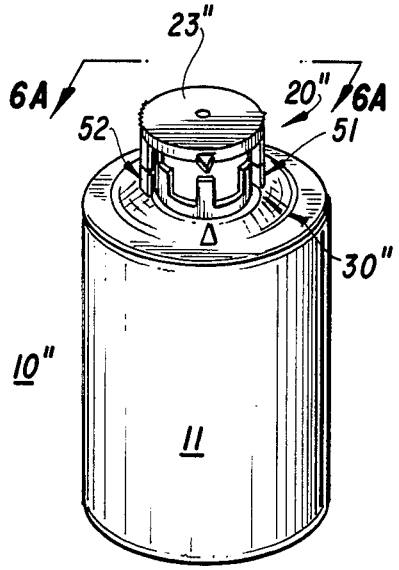
FIG. 5A is a modification of the container of FIG. 1A with a stabilized cap.

A modification of the container in FIG. 1A is provided by the container 10′ of FIG. 5A together with the modified cap 20′.

The cap 20′ is stabilized with respect to the housing 30′ by side structures 51 and 52. These structures 51 and 52 are provided to prevent accidental depression of the cap 20′ into the housing 30′. Each of the structures 51 and 52 includes a downwardly depending stabilizer **51*a* or 52*a* as shown in detail in FIG. 6C. The stabilizers 51*a* and 52*a* are temporarily held in position by supports 51*d* and 52*d* that extend upwardly from the housing 30′. The junction between the members 51*a* and 51*d* includes a relatively narrow connector 51*c*. Similarly in the case of the members 52*a* and 52*d* there is an intervening, relatively narrow connector 52*c***.

Figure 5B:
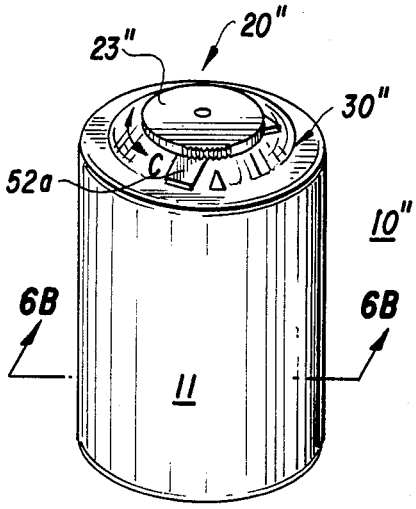
FIG. 5B shows the container of FIG. 5A with the cap depressed.
Figure 6A:
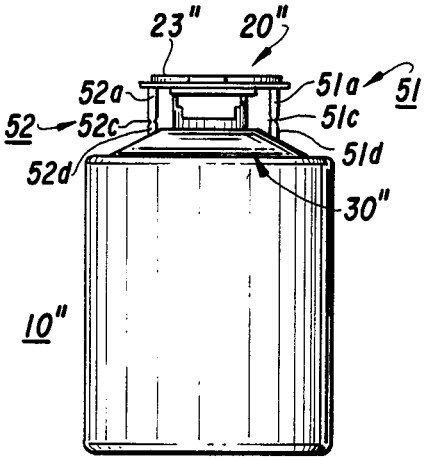
FIG. 6A is a side view of the container of FIG. 5A.
Figure 6B:
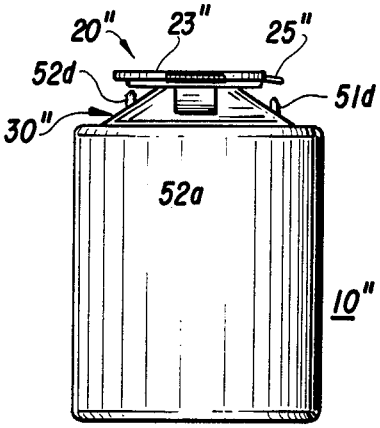
FIG. 6B is a side view of the container of FIG. 5B.
Figure 6C:
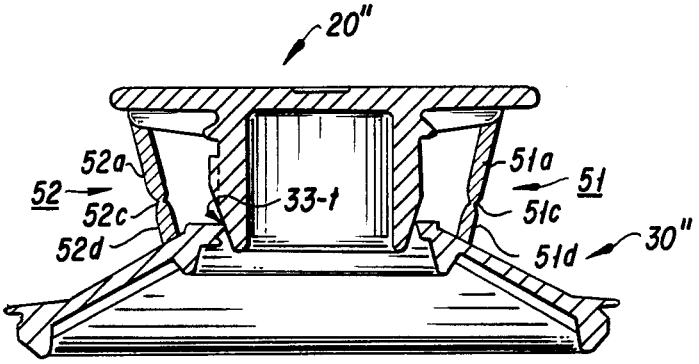
FIG. 6C is a sectional view of the cap and associated housing of FIGS. 5A and 6A.

In order to sever the connectors **51*c* and 52*c* the cap 20′ is twisted in either a clockwise or counterclockwise direction. The cap 20′ can then be depressed into the housing 30′ leaving the stabilizers as side flaps, as shown in FIGS. 5B and 6B for the stabilizer 52*a***.

Figure 7A:
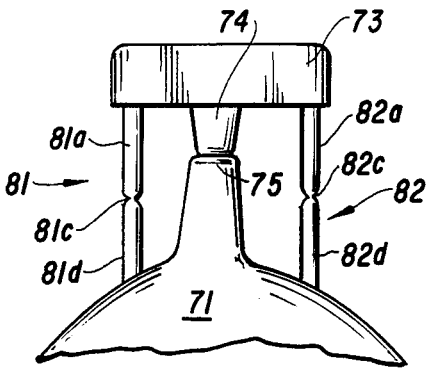
FIG. 7A is a partial view of an alternative stabilized cap and container in accordance with the invention.

A further alternative embodiment is shown in FIG. 7A by the container 70 which has a cap 73 that is joined to a housing 71 at a neck 72 by an integral seal 75 below a plug 74 of the cap 73. In the case of FIG. 7A where the housing 71 includes a relatively long neck 72, the stabilizers 81 and 82 are important in order to prevent premature severence of the seal 75. As in the case of FIG. 6C the cap includes stabilizer segments 81*a* and 82*a* which are joined to respective supports from the container 71, by respective connectors 81*c* and 82*c* of the support stems 81*b* and 82*b*. The relative smallness of the conntectors 81*c* and 82*c* in relation to the stabilizers 81*a* and 82*a* is indicated in the cross sectional view of FIG. 7B. Also indicated is the comparative thinness of the seal 75 which is permitted by the stabilizing structure 81–82.

Figure 7C:
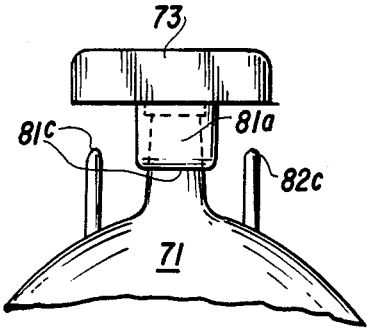
FIG. 7C shows the embodiment of FIG. 7A with the cap twisted to separate the stabilizing side panels and allow depression of the cap into associated container.
Figure 7B:
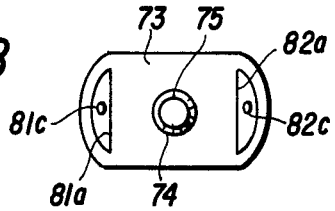
FIG. 7B is a sectional view of FIG. 7A.

FIG. 7C shows the cap 73 after being twisted in a clockwise or counterclockwise direction and depressed into the neck 72, so that the plug 74 has been inserted substantially into the mouth of the neck 72.

It will be appreciated that the lengths of the stabilizers and supports can be varied. It is particularly advantageous for the supports to be comparatively short in order to avoid objectionable protuberences on the container surface. In some cases the supports are completely eliminated and the stabilizers are connected directly to the housing 71 by their associated connectors. In other cases the stabilizers are omitted and the supports are connected to the cap 73 by reduced diameter connectors. In this situation the support serves both a stabilizing and support function.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A tamper-proof closure comprising a cap that is integrally sealed to a housing;

said cap having a body portion that extends above the level of the seal to said housing to provide a clear visual indication that the connection of the cap to the housing has not been disturbed;

a flange on said cap to facilitate the rupture of the seal connecting said cap to said housing and providing a clear visual indication of when the seal of the cap to the housing has been disturbed; and means interconnecting said flange and said housing for stabilizing said seal against accidental rupture.

2. A closure in accordance with claim 1 wherein means are provided for permitting the removal of said cap from said housing and the repositioning of said cap on said housing only when said cap and said housing have a prescribed orientation relative to one another.

3. A closure in accordance with claim 2 wherein said housing is provided with stop means for specifying the alignment with said cap that permits the separation or insertion of said cap with respect to said housing.

4. A closure in accordance with claim 2 wherein said cap includes a plurality of inclined ramps on its body portion for locking said cap to said housing after the seal between the two is broken to permit moisture resistant engagement.

5. A closure in accordance with claim 2 wherein said housing includes a plurality of inclined ramps below the seal thereof in order to lock said cap to said housing after the seal between the two is broken.

6. A closure in accordance with claim 1 wherein said flange has an eccentric lip which extends beyond the body of said cap to facilitate the application of force for the rupture of said seal between said cap and said housing.

7. A closure in accordance with claim 6 wherein said cap includes tapered ramps which are symmetrically disposed with respect to said eccentric lip away from the position of maximum eccentricity thereof.

8. A closure in accordance with claim 2 wherein the repositioning means comprises a plurality of outwardly tapered fingers on the body of said cap and a corresponding plurality of tapered sections on said housing which are bendable when said cap is depressed into said housing.

9. A closure in accordance with claim 1 wherein the seal which integrally joins said housing with said cap has a tapered increasing thickness from said housing to said cap.

10. A closure in accordance with claim 9 wherein the maximum thickness of said seal at its position of connection to said cap is 0.008 inch.

11. A closure in accordance with claim 1 wherein the stabilizing means comprises a member interconnecting said cap and said housing which is readily severable in torsion but is resistant to other non-torsional forces.

12. A closure in accordance with claim 4 wherein said member is connected to said cap or said housing by a connector which is substantially smaller in cross section than said member.

13. A closure as defined in claim 12 wherein said member is in two parts with said connector therebetween, with one part joined to said cap and the other part joined to said housing.

14. A closure in accordance with claim 1 wherein said housing includes a neck portion which receives a plug of said cap and is joined thereto by an integral seal.

15. The method of stabilizing a cap joined to a container by an integral seal which comprises providing at least one member externally interconnecting said cap and said housing, which is more readily severable by torsion applied to said cap than by non-torsional forces applied thereto.

16. The method of claim 15 wherein said cap is separated from said housing by a torsional force which severs a temporary connection between said housing and said cap and thereafter depressing said cap into said housing.

17. The method of claim 16 wherein said cap is joined to said housing at a neck portion thereof by a plug of said cap which is rotatable with respect to said neck and depressable thereinto.

18. The method of claim 15 wherein said member is provided in the form of a flap which becomes flattened when said cap is rotated and depressed into said housing; thereby to provide a clear visual indication that the seal between said cap and said housing has been broken.

19. The method of manufacturing a closure comprising molding a cap that is integrally sealed to a housing, with said cap having a body portion that extends above said seal to provide a visual indication of when the cap is disturbed relative to the housing by the depression of said cap into said housing and further providing means for stabilizing said seal against accidental rupture.

* * * * *